US009378700B2

(12) United States Patent
Lai

(10) Patent No.: US 9,378,700 B2
(45) Date of Patent: Jun. 28, 2016

(54) DEVICE AND METHOD FOR ADJUSTING A POWER SUPPLY VOLTAGE FOR A DISPLAY PANEL, AND DISPLAY DEVICE

(71) Applicants: BOE TECHNOLOGY GROUP CO., LTD, Beijing (CN); BEIJING BOE DISPLAY TECHNOLOGY CO., LTD, Beijing (CN)

(72) Inventor: Yiqiang Lai, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 62 days.

(21) Appl. No.: 14/314,144

(22) Filed: Jun. 25, 2014

(65) Prior Publication Data

US 2015/0262541 A1 Sep. 17, 2015

(30) Foreign Application Priority Data

Mar. 13, 2014 (CN) ..... 2014 1 0093094

(51) Int. Cl.

| | |
|---|---|
| ***G09G 5/00*** | (2006.01) |
| ***G09G 3/36*** | (2006.01) |
| ***G09G 5/18*** | (2006.01) |

(52) U.S. Cl.

CPC ..... *G09G 3/3696* (2013.01); *G09G 3/3611* (2013.01); *G09G 5/18* (2013.01); *G09G 2320/0673* (2013.01); *G09G 2330/021* (2013.01)

(58) Field of Classification Search

CPC ..... G09G 3/36; G09G 3/3696; G09G 3/3688; G09G 5/18; G09G 2330/00; G09G 2330/02; G09G 2330/021

See application file for complete search history.

(56) References Cited

U.S. PATENT DOCUMENTS

| | | | | |
|---|---|---|---|---|
| 2001/0030645 | A1* | 10/2001 | Tsutsui | G09G 3/3611 345/211 |
| 2006/0114217 | A1* | 6/2006 | Kim | G09G 3/20 345/100 |
| 2007/0040825 | A1* | 2/2007 | Mamba | G09G 3/3614 345/211 |
| 2008/0001894 | A1* | 1/2008 | Oh | G09G 3/3677 345/98 |
| 2008/0001897 | A1* | 1/2008 | Lim | G09G 3/3688 345/98 |
| 2008/0170064 | A1* | 7/2008 | Lee | G09G 3/3677 345/214 |
| 2009/0027373 | A1* | 1/2009 | Chiang | G09G 3/20 345/212 |

(Continued)

FOREIGN PATENT DOCUMENTS

| | | |
|---|---|---|
| CN | 102376249 A | 3/2012 |
| CN | 102645771 A | 8/2012 |

(Continued)

OTHER PUBLICATIONS

Chinese Patent Application No. 201410093094.1, Office Action dated Sep. 30, 2015, seven (7) pages, English translation five (5) pages.

*Primary Examiner* — Joe H Cheng

(74) *Attorney, Agent, or Firm* — Nath, Goldberg & Meyer; Joshua B. Goldberg

(57) ABSTRACT

The present invention provides a device for adjusting a power supply voltage for a display panel, comprising a timing controller and a power management unit connected thereto, wherein the timing controller is able to send a power supply voltage reduction signal to the power management unit, and the power management unit is able to output a reduced power supply voltage according to the power supply voltage reduction signal.

13 Claims, 1 Drawing Sheet

(56) References Cited

U.S. PATENT DOCUMENTS

2009/0096818 A1* 4/2009 Nishimura ..... G09G 3/3291 345/690
2009/0109147 A1* 4/2009 Park ..... G09G 3/20 345/76
2009/0109158 A1* 4/2009 Shirai ..... G09G 3/3655 345/94
2009/0244110 A1* 10/2009 Ogura ..... G09G 3/3233 345/690
2009/0310077 A1* 12/2009 Kim ..... G09G 3/3614 349/151
2011/0057914 A1* 3/2011 Nam ..... G09G 3/3648 345/211
2011/0102406 A1* 5/2011 Wang ..... G09G 3/3677 345/211
2012/0030491 A1* 2/2012 Itou ..... G03G 15/5004 713/323
2012/0044231 A1* 2/2012 Park ..... G06F 1/263 345/211
2012/0044273 A1* 2/2012 Park ..... G09G 3/20 345/690
2012/0133628 A1* 5/2012 Kim ..... G09G 3/3614 345/208
2012/0146520 A1* 6/2012 Liu ..... G09G 3/3406 315/192
2012/0169698 A1* 7/2012 Park ..... G09G 3/20 345/211
2013/0088477 A1* 4/2013 Seong ..... G09G 1/005 345/211
2013/0127701 A1 5/2013 Cho et al.
2013/0293451 A1* 11/2013 Yeh ..... G09G 3/36 345/99
2014/0084792 A1* 3/2014 Oh ..... H05B 37/02 315/120
2014/0111402 A1* 4/2014 Kim ..... G09G 3/3291 345/76
2014/0160182 A1* 6/2014 Hong ..... G09G 3/3696 345/691
2014/0375700 A1* 12/2014 Takahama ..... G09G 3/30 345/690

FOREIGN PATENT DOCUMENTS

CN 103165066 A 6/2013
EP 1139551 A2 10/2001

* cited by examiner

DEVICE AND METHOD FOR ADJUSTING A POWER SUPPLY VOLTAGE FOR A DISPLAY PANEL, AND DISPLAY DEVICE

This application claims foreign priority of the Chinese Application Serial No. 20140093094.1, filed on Mar. 13, 2014.

FIELD OF THE INVENTION

The present invention relates to the field of display technology, and particularly to a device and a method for adjusting a power supply voltage for a display panel, and a display device including the device for adjusting a power supply voltage for a display panel.

BACKGROUND OF THE INVENTION

In a liquid crystal display device, power consumption caused by load of a display panel is one of the major parts of the total power consumption of the display panel. The power consumption caused by the load of the display panel is associated with a power supply voltage for driving the display panel, and when the load of the display panel is fixed, the higher the power supply voltage for driving the display panel is, the larger power consumption the load of the display panel will cause Generally, in the liquid crystal display device, for better contrast and quicker response, value of the power supply voltage for driving the display panel may be increased as much as possible.

However, when the display panel is not required to have a high contrast and a quick response (for example, when a static image or paperwork is displayed), a lower power supply voltage may be used for the display panel so as to lower the power consumption. In addition, when a mobile device in use goes into an energy-saving mode, a lower power supply voltage may also be used for the display panel so as to lower the power consumption.

Therefore, it is required to provide a device and a method for adjusting a supply power for a display panel, so as to lower the supply power for driving the display panel when necessary.

SUMMARY OF THE INVENTION

In view of the above, an object of the present invention is to provide a device and a method for adjusting a power supply voltage for a display panel, and a display device comprising the device for adjusting a power supply voltage for a display panel, which can lower the supply power for the display panel.

To achieve the above object, the present invention provides a device for adjusting a power supply voltage for a display panel, comprising a timing controller and a power management unit connected thereto, wherein the timing controller is able to send a power supply voltage reduction signal to the power management unit, and the power management unit is able to output a reduced power supply voltage according to the power supply voltage reduction signal.

Preferably, the device for adjusting a power supply voltage for a display panel further comprises a gamma adjustment unit connected to the timing controller, wherein the timing controller is able to send a first gamma voltage selection signal to the gamma adjustment unit, and the gamma adjustment unit is able to select and output a gamma voltage corresponding to the reduced power supply voltage according to the first gamma voltage selection signal.

Preferably, the timing controller is also able to send a power supply voltage recovery signal to the power management unit, and the power management unit is able to output a normal power supply voltage according to the power supply voltage recovery signal.

Preferably, the timing controller is also able to send a second gamma voltage selection signal to the gamma adjustment unit, the gamma adjustment unit is able to select and output a gamma voltage corresponding to the normal power supply voltage according to the second gamma voltage selection signal.

Preferably, a first voltage value and a second voltage value which is smaller than the first voltage value are pre-stored in the timing controller, the power supply voltage reduction signal includes the second voltage value therein, the reduced power supply voltage corresponds to the second voltage value, the power supply voltage recovery signal includes the first voltage value therein, and the normal power supply voltage corresponds to the first voltage value.

Preferably, a first gamma voltage set corresponding to the first voltage value and a second gamma voltage set corresponding to the second voltage value are pre-stored in the gamma adjustment unit.

Preferably, the timing controller is connected to the power management unit via an I2C bus.

Preferably, the timing controller is provided with an energy-saving interface for receiving an energy-saving enable signal and an energy-saving disable signal.

Accordingly, the present invention also provides a method for adjusting a power supply voltage for a display panel by using a device for adjusting a power supply voltage for a display panel, comprising a timing controller and a power management unit connected thereto, wherein the timing controller is able to send a power supply voltage reduction signal to the power management unit, and the power management unit is able to output a reduced power supply voltage according to the power supply voltage reduction signal, and the method comprising a step of:

S1: the timing controller sending the power supply voltage reduction signal to the power management unit upon receipt of an energy-saving enable signal, and the power management unit outputting the reduced power supply voltage according to the power supply voltage reduction signal.

Preferably, the device for adjusting a power supply voltage for a display panel further comprises a gamma adjustment unit connected to the timing controller, and the step S1 further comprises: the timing controller sending a first gamma voltage selection signal to the gamma adjustment unit upon receipt of the energy-saving enable signal, and the gamma adjustment unit outputting a gamma voltage corresponding to the reduced power supply voltage according to the first gamma voltage selection signal.

Preferably, the method further comprises a step of:

S2: the timing controller sending a power supply voltage recovery signal to the power management unit upon receipt of an energy-saving disable signal, and the power management unit outputting a normal power supply voltage according to the power supply voltage recovery signal.

Preferably, the step S2 further comprises: the timing controller sending a second gamma voltage selection signal to the gamma adjustment unit upon receipt of the energy-saving enable signal, and the gamma adjustment unit outputting a gamma voltage corresponding to the normal power supply voltage according to the second gamma voltage selection signal.

Preferably, a first voltage value and a second voltage value which is smaller than the first voltage value are pre-stored in the timing controller, and in the step S1, the timing controller sending a power supply voltage reduction signal including the second voltage value to the power management unit upon receipt of the energy-saving enable signal, and the power management unit outputting a power supply voltage corresponding to the second voltage value according to the power supply voltage reduction signal; in the step S2, the timing controller sending a power supply voltage recovery signal including the first voltage value to the power management unit upon receipt of the energy-saving disable signal, and the power management unit outputting a power supply voltage corresponding to the first voltage value according to the power supply voltage recovery signal.

Preferably, a first gamma voltage set corresponding to the first voltage value and a second gamma voltage set corresponding to the second voltage value are pre-stored in the gamma adjustment unit, and in the step S1, the timing controller sends a first gamma voltage selection signal to the gamma adjustment unit upon receipt of the energy-saving enable signal, and the gamma adjustment unit outputs the second gamma voltage set according to the first gamma voltage selection signal, and in the step S2, the timing controller sends a second gamma voltage selection signal to the gamma adjustment unit upon receipt of the energy-saving disable signal, and the gamma adjustment unit outputs the first gamma voltage set according to the second gamma voltage selection signal.

Accordingly, the present invention also provides a display device comprising the above-described device for adjusting a power supply voltage for a display panel, wherein the power management unit is electrically connected to power supply of the display device.

It can be seen that, in the present invention, the timing controller sends a power supply voltage reduction signal to the power management unit, so that the power management unit can output a reduced power supply voltage accordingly, thus lowering power consumption. Meanwhile, the timing controller can also send a gamma voltage selection signal to the gamma adjustment unit, so that the gamma adjustment unit outputs a gamma voltage corresponding to the power supply voltage.

BRIEF DESCRIPTION OF THE DRAWINGS

The following drawings provided for further understanding of the present invention constitute a part of the specification, and, together with the following specific implementations, are used for explaining the present invention, rather than limiting the present invention, in which.

DETAILED DESCRIPTION OF THE EMBODIMENTS

The specific implementations of the present invention are described below in detail in conjunction with the accompanying drawings. It should be understood that the specific implementations described herein are merely used for describing and explaining the present invention, but not for limiting the present invention.

Figure 1:
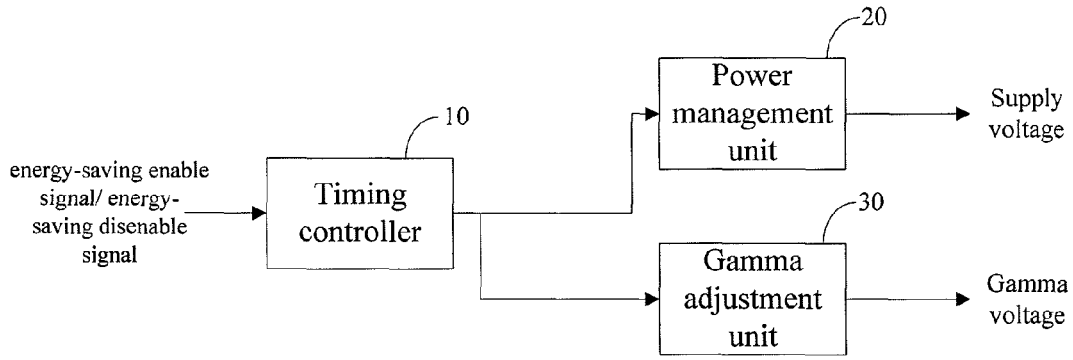
FIG. 1 is a schematic diagram of a device for adjusting a power supply voltage for a display panel provided by the present invention.

As an aspect of the present invention, a device for adjusting a power supply voltage for a display panel is provided. As shown in FIG. 1, the device for adjusting a power supply voltage for a display panel includes a timing controller 10 and a power management unit 20 connected to the timing controller 10, the timing controller 10 can send a power supply voltage reduction signal to the power management unit 20, and the power management unit 20 can output a reduced power supply voltage according to the received power supply voltage reduction signal.

When a display panel is not required to have high contrast and quick response, or when a mobile display device goes into an energy-saving mode, the above device for adjusting a power supply voltage for a display panel may lower the power supply voltage applied to the display panel so as to lower power consumption. Specifically, when it is required to lower the power supply voltage supplied to the display panel, the timing controller 10 may send the power supply voltage reduction signal to the power management unit 20, and the power management unit 20 may output the reduced power supply voltage according to the received power supply voltage reduction signal.

Generally, power consumption caused by load of a display panel may be calculated according to the formula $P=(1/2)CfV^2$, wherein, C is the equivalent capacitive load of the display panel, f is the frequency of alternating current charging the capacitive load, and V is the power supply voltage. It is thus clear that when C and f are fixed, reducing the power supply voltage may greatly lower power consumption.

Further, when the display panel is required to have high contrast and quick response, or when the mobile display device exits the energy-saving mode, the above device for adjusting a power supply voltage for a display panel may resume supplying a normal power supply voltage to the display panel, Specifically, when it is required to return to the normal power supply voltage to be applied to the display panel, the timing controller 10 may send the power supply voltage recovery signal to the power management unit 20, and the power management unit 20 may output the normal power supply voltage according to the power supply voltage recovery signal.

Further, a first voltage value and a second voltage value may be pre-stored in the timing controller 10, and the second voltage value may be smaller than the first voltage value. The power supply voltage reduction signal sent to the power management unit 20 from the timing controller 10 may include the second voltage value, and the power management unit 20 may output a power supply voltage corresponding to the second voltage value according to the power supply voltage reduction signal; in addition, the power supply voltage recovery signal sent to the power management unit 20 from the timing controller 10 may include the first voltage value, and the power management unit 20 may output a power supply voltage corresponding to the first voltage value according to the power supply voltage recovery signal. Specifically, the first voltage value and the second voltage value may be pre-stored in the timing controller 10, and the second voltage value may be smaller than the first voltage value, that is, the first voltage value corresponds to the value of the power supply voltage when the display panel operates normally, and the second voltage value corresponds to the value of the power supply voltage when power consumption needs to be lowered. When power consumption needs to be lowered, the timing controller 10 may send a power supply voltage reduction signal including the second voltage value to the power management unit 20, and afterwards, the power management unit 20 may output the power supply voltage corresponding to the second voltage value according to the power supply voltage reduction signal. When the energy-saving mode in which power consumption is reduced needs to be terminated, the timing controller 10 may send a power supply voltage recovery signal including the first voltage value to the power management unit 20, and afterwards, the power management unit 20 may output the power supply voltage corresponding to the first voltage value according to the power supply voltage recovery signal.

Further, the device for adjusting a power supply voltage for a display panel further comprises a gamma adjustment unit 30 connected to the timing controller 10, the timing controller 10 can send a gamma voltage selection signal to the gamma adjustment unit 30, and the gamma adjustment unit 30 can select and output a gamma voltage corresponding to the power supply voltage according to the gamma voltage selection signal. In general, in a display device, deviation in brightness of a displayed picture exists due to a video card or a display panel, and in this case, gamma value of the display device should be maintained at a value of 2.2 through outputting a corresponding gamma voltage by the gamma adjustment unit, so as to correct the brightness of the picture. This part belongs to prior art, and therefore is not elaborated herein.

To maintain the gamma value at 2.2, it is required to adjust the value of the gamma voltage output by the gamma adjustment unit 30, while the power management unit 20 outputs the reduced supply power. Specifically, the timing controller 10 may send a first gamma voltage selection signal to the gamma adjustment unit 30, and the gamma adjustment unit 30 may select and output a gamma voltage corresponding to the reduced supply power according to the first gamma voltage selection signal. While the power management unit 20 outputs the normal power supply voltage, the timing controller 10 may send a second gamma voltage selection signal to the gamma adjustment unit 30, and the gamma adjustment unit 30 can select and output a gamma voltage corresponding to the normal power supply voltage according to the second gamma voltage selection signal.

Further, a first gamma voltage set and a second gamma voltage set are pre-stored in the gamma adjustment unit 30, wherein, the first gamma voltage set corresponds to the above first voltage value, and the second gamma voltage set corresponds to the above second voltage value. Specifically, when power consumption needs to be lowered, the timing controller 10 may send the first gamma voltage selection signal to the gamma adjustment unit 30, and the gamma adjustment unit 30 outputs the second gamma voltage set corresponding to the second voltage value; when the energy-saving mode in which power consumption is lowered needs to be terminated, the timing controller 10 may send the second gamma voltage selection signal to the gamma adjustment unit 30, and the gamma adjustment unit 30 outputs the first gamma voltage set corresponding to the first voltage value.

Further, the timing controller 10 may be connected to the power management unit 20 via I2C (Inter-Integrated Circuit) bus. Specifically, the power supply voltage reduction signal or the power supply voltage recovery signal may be sent to the power management unit 20 from the timing controller 10 via the I2C bus, to enable the power management unit 20 to adjust power supply voltage immediately.

Further, the timing controller 10 may be provided with an energy-saving signal interface, which can be used for receiving an energy-saving enable signal and an energy-saving disable signal. Specifically, the timing controller 10 may be provided with the energy-saving signal interface for receiving the energy-saving enable signal and the energy-saving disable signal, and the interface may be, for example, a pin of the timing controller 10.

Figure 2:
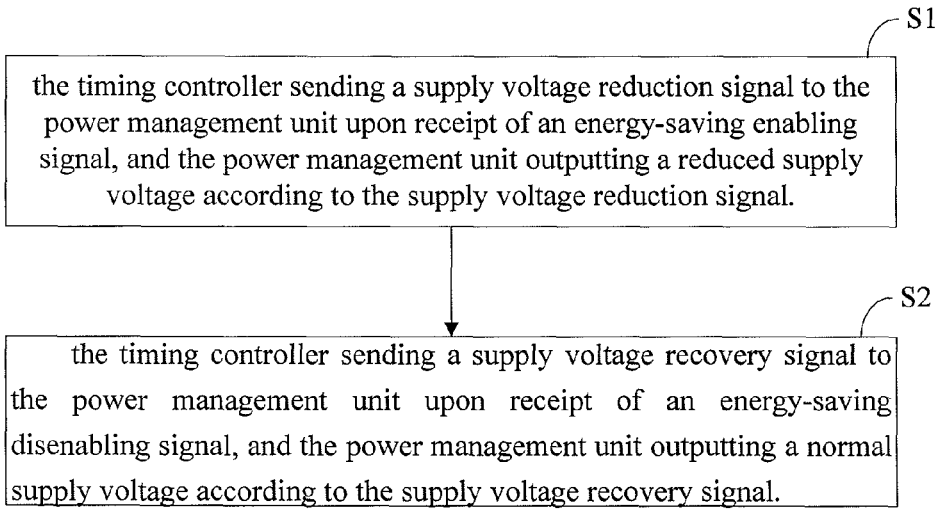
FIG. 2 is a flow chart of a method for adjusting a power supply voltage for a display panel provided by the present invention.

As another aspect of the present invention, the present invention provides a method for adjusting a power supply voltage for a display panel, and the method uses the above device provided by the present invention to achieve adjustment of the power supply voltage of the display panel. As shown in FIG. 2, the method may comprise a step of:

S1: the timing controller sending the power supply voltage reduction signal to the power management unit upon receipt of an energy-saving enable signal, and the power management unit outputting the reduced power supply voltage according to the power supply voltage reduction signal.

Specifically, the timing controller may send the power supply voltage reduction signal to the power management unit upon receipt of the energy-saving enable signal, so that the power management unit may output the reduced supply voltage.

Further, the above device for adjusting a power supply voltage for a display panel further comprises a gamma adjustment unit, which may be connected to the timing controller, and the step S1 may further comprise: the timing controller sending a first gamma voltage selection signal to the gamma adjustment unit upon receipt of the energy-saving enable signal, and the gamma adjustment unit outputting a gamma voltage corresponding to the reduced power supply voltage according to the first gamma voltage selection signal.

Further, the method may further comprise a step of:

S2: the timing controller sending a power supply voltage recovery signal to the power management unit upon receipt of an energy-saving disable signal, and the power management unit outputting the normal power supply voltage according to the power supply voltage recovery signal.

Further, the step S2 may further comprise: the timing controller sending a second gamma voltage selection signal to the gamma adjustment unit upon receipt of the energy-saving enable signal, and the gamma adjustment unit outputting a gamma voltage corresponding to the normal power supply voltage according to the second gamma voltage selection signal.

Specifically, upon receipt of an energy-saving disable signal, that is, when a normal operation mode needs to be resumed, the timing controller may send the power supply voltage recovery signal to the power management unit, and the power management unit outputs a power supply voltage corresponding to the normal operating voltage.

Further, a first voltage value and a second voltage value which is smaller than the first voltage value are pre-stored in the timing controller, and in the above step S1, the timing controller sends the power supply voltage reduction signal including the second voltage value to the power management unit upon receipt of the energy-saving enable signal, and the power management unit outputs a power supply voltage corresponding to the second voltage value according to the power supply voltage reduction signal; in the above step S2, the timing controller sends the power supply voltage recovery signal including the first voltage value to the power management unit upon receipt of the energy-saving disable signal, and the power management unit outputs a power supply voltage corresponding to the first voltage value according to the power supply voltage recovery signal.

Preferably, a first gamma voltage set corresponding to the first voltage value and a second gamma voltage set corresponding to the second voltage value are pre-stored in the gamma adjustment unit, and in the above step S1, the timing controller may also send a first gamma voltage selection signal to the gamma adjustment unit upon receipt of the energy-saving enable signal, and the gamma adjustment unit may output the second gamma voltage set corresponding to the second voltage value according to the first gamma voltage selection signal; and in the above step S2, the timing controller may also send a second gamma voltage selection signal to the gamma adjustment unit upon receipt of the energy-saving disable signal, and the gamma adjustment unit may output the first gamma voltage set corresponding to the first voltage value according to the second gamma voltage selection signal.

It should be noted that in the above device and method for adjusting a power supply voltage for a display panel provided by the present invention, whether an energy-saving operating mode with lowered power consumption needs to be enabled is determined artificially or determined automatically through a preset program. For example, a determining program may be preset, and when it is determined that an object displayed on the display device does not require high contrast and quick response (for example, when a PDF document is displayed), an energy-saving enable signal is sent to the timing controller and the energy-saving operating mode with lowered power consumption is enabled automatically; when it is determined that an object displayed on the display panel requires high contrast and quick response (for example, when a video is displayed), an energy-saving disable signal is sent to the timing controller and the energy-saving operating mode with lowered power consumption is disabled automatically.

The device and method for adjusting a power supply voltage for a display panel provided by the present invention are described above, and it can be seen that, in the present invention, the timing controller sends a power supply voltage reduction signal to the power management unit, so that the power management unit can output a reduced power supply voltage accordingly, thus lowering power consumption. Meanwhile, the timing controller can also send a gamma voltage selection signal to the gamma adjustment unit, so that the gamma adjustment unit can output a gamma voltage corresponding to the supply voltage.

As still another aspect of the present invention, the present invention provides a display device, which may comprises the above-described device for adjusting a power supply voltage for a display panel provided by the present invention, wherein the power management unit is electrically connected to power supply of the display device. Specifically, the power management unit may be electrically connected to the power supply of the display device through a connector of the display device, such that the power supply may provide voltage to the power management unit through the connector. Of course, the display device also comprises other known structures such as a display panel, and the like, and these structures are not described in detail herein.

It should be noted that the timing controller in the device for adjusting a power supply voltage for a display panel provided by the present invention may be a timing controller provided separately, or may be an existing timing controller for controlling and driving the display panel in the display device. If the timing controller is an existing timing controller for controlling and driving the display panel in the display device, one end of the timing controller may be connected to the connector of the display device so as to acquire image signals, and the other end may be connected to the power management unit, the gamma adjustment unit and a data driving unit (so as to provide an image signal to the data driving unit). Accordingly, the power management unit and the gamma adjustment unit may be connected to the data driving unit, so as to provide a power supply voltage to the data driving unit.

It can be understood that the above implementations are merely exemplary implementations used for explaining the principle of the present invention, but the present invention is not limited thereto. For those skilled in the art, various modifications and improvements may be made without departing from the spirit and essence of the present invention, and these modifications and improvements may also be considered to be the protection scope of the present invention.

The invention claimed is:

1. A device for adjusting a power supply voltage for a display panel, comprising a timing controller and a power management unit connected thereto, wherein the timing controller is able to send a power supply voltage reduction signal to the power management unit, and the power management unit is able to output a reduced power supply voltage according to the power supply voltage reduction signal, and wherein the timing controller is also able to send a power supply voltage recovery signal to the power management unit, and the power management unit is able to output a normal power supply voltage according to the power supply voltage recovery signal.

2. The device of claim 1, further comprising a gamma adjustment unit connected to the timing controller, wherein the timing controller is able to send a first gamma voltage selection signal to the gamma adjustment unit, and the gamma adjustment unit is able to select and output a gamma voltage corresponding to the reduced power supply voltage according to the first gamma voltage selection signal.

3. The device of claim 1, wherein the timing controller is also able to send a second gamma voltage selection signal to the gamma adjustment unit, the gamma adjustment unit is able to select and output a gamma voltage corresponding to the normal power supply voltage according to the second gamma voltage selection signal.

4. The device of claim 3, wherein a first voltage value and a second voltage value which is smaller than the first voltage value are pre-stored in the timing controller, the power supply voltage reduction signal includes the second voltage value therein, the reduced power supply voltage corresponds to the second voltage value, the power supply voltage recovery signal includes the first voltage value therein, and the normal power supply voltage corresponds to the first voltage value.

5. The device of claim 4, wherein a first gamma voltage set corresponding to the first voltage value and a second gamma voltage set corresponding to the second voltage value are pre-stored in the gamma adjustment unit.

6. The device of claim 1, wherein the timing controller is connected to the power management unit via an I2C bus.

7. The device of claim 1, wherein the timing controller is provided with an energy-saving interface for receiving an energy-saving enable signal and an energy-saving disable signal.

8. A method for adjusting a power supply voltage for a display panel by using a device for adjusting a power supply voltage for a display panel, the device for adjusting a power supply voltage for a display panel comprising a timing controller and a power management unit connected thereto, wherein the timing controller is able to send a power supply voltage reduction signal to the power management unit, and the power management unit is able to output a reduced power supply voltage according to the power supply voltage reduction signal, and the method comprising steps of:

S1: the timing controller sending the power supply voltage reduction signal to the power management unit upon receipt of an energy-saving enable signal, and the power management unit outputting the reduced power supply voltage according to the power supply voltage reduction signal; and S2: the timing controller sending a power supply voltage recovery signal to the power management unit upon receipt of an energy-saving disable signal, and the power management unit outputting a normal power supply voltage according to the power supply voltage recovery signal.

9. The method of claim 8, wherein the device for adjusting a power supply voltage for a display panel further comprises a gamma adjustment unit connected to the timing controller, and the step S1 further comprises: the timing controller sending a first gamma voltage selection signal to the gamma adjustment unit upon receipt of the energy-saving enable signal, and the gamma adjustment unit outputting a gamma voltage corresponding to the reduced power supply voltage according to the first gamma voltage selection signal.

10. The method of claim 8, wherein the step S2 further comprises:

the timing controller sending a second gamma voltage selection signal to the gamma adjustment unit upon receipt of the energy-saving enable signal, and the gamma adjustment unit outputting a gamma voltage corresponding to the normal power supply voltage according to the second gamma voltage selection signal.

11. The method of claim 10, wherein a first voltage value and a second voltage value which is smaller than the first voltage value are pre-stored in the timing controller, and in the step S1, the timing controller sends a power supply voltage reduction signal including the second voltage value to the power management unit upon receipt of the energy-saving enable signal, and the power management unit outputs a power supply voltage corresponding to the second voltage value according to the power supply voltage reduction signal; in the step S2, the timing controller sends a power supply voltage recovery signal including the first voltage value to the power management unit upon receipt of the energy-saving disable signal, and the power management unit outputs a power supply voltage corresponding to the first voltage value according to the power supply voltage recovery signal.

12. The method of claim 11, wherein a first gamma voltage set corresponding to the first voltage value and a second gamma voltage set corresponding to the second voltage value are pre-stored in the gamma adjustment unit, and in the step S1, the timing controller sends a first gamma voltage selection signal to the gamma adjustment unit upon receipt of the energy-saving enable signal, and the gamma adjustment unit outputs the second gamma voltage set according to the first gamma voltage selection signal, and in the step S2, the timing controller sends a second gamma voltage selection signal to the gamma adjustment unit upon receipt of the energy-saving disable signal, and the gamma adjustment unit outputs the first gamma voltage set according to the second gamma voltage selection signal.

13. A display device comprising the device of claim 1, wherein the power management unit is electrically connected to power supply of the display device.

* * * * *